US008836240B2

(12) United States Patent
Kumar et al.

(10) Patent No.: US 8,836,240 B2
(45) Date of Patent: Sep. 16, 2014

(54) DIM MODE START FOR ELECTRODELESS LAMP BALLAST

(75) Inventors: Nitin Kumar, Burlington, MA (US); Markus Ziegler, Watertown, MA (US); Robert Martin, Nicholasville, KY (US); Shashank Bakre, Woburn, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 202 days.

(21) Appl. No.: 13/539,402

(22) Filed: Jun. 30, 2012

(65) Prior Publication Data

US 2014/0001971 A1 Jan. 2, 2014

(51) Int. Cl.
*H05B 37/02* (2006.01)

(52) U.S. Cl.
USPC ..... 315/307; 315/200 R; 315/360

(58) Field of Classification Search
CPC ..... H05B 37/02; H05B 37/0245; H05B 37/0281; H05B 39/02; H05B 41/16; H05B 41/36
USPC ..... 315/200 R, 291, 307, 308, 360
See application file for complete search history.

(56) References Cited

U.S. PATENT DOCUMENTS

| | | | | |
|---|---|---|---|---|
| 5,872,429 | A * | 2/1999 | Xia et al. | 315/194 |
| 6,628,089 | B2 * | 9/2003 | Suomi | 315/194 |
| 6,963,178 | B1 * | 11/2005 | Lev et al. | 315/307 |
| 7,880,405 | B2 * | 2/2011 | Chitta et al. | 315/307 |

* cited by examiner

*Primary Examiner* — Tung X Le
(74) *Attorney, Agent, or Firm* — Shaun P. Montana

(57) ABSTRACT

A ballast for energizing a lamp at a lighting level selected from a plurality of lamp lighting levels. The ballast includes a buck converter circuit configured to receive a DC voltage signal having a substantially constant magnitude. The buck converter circuit has a duty cycle for generating a lamp voltage output signal from the DC voltage signal. The lamp voltage output signal has a magnitude that is varied by the duty cycle to energize the lamp at the plurality of lamp lighting levels. A controller is configured to receive a dim input signal indicative of the selected lamp lighting level and to provide a control signal to the buck converter circuit as a function of the dim input signal. The control signal indicates a particular duty cycle corresponding to a lamp voltage output signal having a magnitude for energizing the lamp at the selected lamp lighting level.

18 Claims, 6 Drawing Sheets

DIM MODE START FOR ELECTRODELESS LAMP BALLAST

TECHNICAL FIELD

The present invention relates to lighting, and more specifically, to electronic ballasts for lighting.

BACKGROUND

Multiple level lighting systems are used in various different lighting applications, for example overhead lighting in offices. Such lighting systems can be used to conserve energy, because they allow less than the full light output to be used when not necessary. In addition to providing energy savings, multiple level lighting systems enhance productivity in commercial environments by providing those in the workplace with the ability to customize lighting levels in their individual work spaces.

However, providing lighting systems that have the ability to initially energize at multiple dim lighting levels can create starting and stability challenges. For example, when an electrodeless lamp is started, the lamp goes through a normal stabilization process which is dependent on the partial mercury vapor pressure. This start process is frequently referred to as the run-up time, or simply run-up. During run-up in an electrodeless lamp, lamp power and lumen output will follow the partial mercury vapor pressure progression and will typically start low, go through a peak, and then come back up again and stabilize according to the final partial mercury vapor pressure, which will depend mainly on the amalgam temperature.

SUMMARY

Conventional run-up of an electrodeless lamp, as well other types of gas discharge lamps, when used in multiple level lighting systems suffer from a variety of deficiencies. When a gas discharge lamp in such a system is started in a dim mode (i.e., at less than full light output), the power of the lamp will be lower because the dim mode implements less power. This results in a lower lamp current, so that the lamp voltage will be higher (a lamp has a negative V-I curve), which will increase the losses in the ferrite cores, which are proportional to the lamp voltage. Consequently, the discharge power of the lamp becomes even lower, because the discharge power is equal to the lamp power minus the core losses. Thus, during run-up in a dim mode, while the partial mercury vapor pressure is low, the lamp may operate at a discharge power that is too low to sustain the electron density. Thus may cause the lamp to extinguish.

It is desirable to have a multiple level lighting system that is capable of providing multiple light levels that allow for consistent starts in various dim modes having numerous power levels below full operating power at full intensity to ensure lamp stability during starting. Embodiments of the present invention provide a multiple level lighting system with consistent starting in dim lighting levels.

In an embodiment, there is provided a ballast. The ballast includes: a rectifier to receive an alternating current (AC) voltage signal from an AC power supply and to produce a direct current (DC) voltage signal therefrom; a buck converter circuit connected to the rectifier to receive the DC voltage signal, wherein the DC voltage signal has a magnitude that is substantially constant, the buck converter circuit has a duty cycle to generate a lamp voltage output signal from the DC voltage signal, the lamp voltage output signal applied to a lamp to energize the lamp, wherein the lamp voltage output signal has a magnitude that is varied by the duty cycle to energize the lamp at a plurality of lamp lighting levels; and a controller connected to the buck converter circuit, the controller configured to receive a dim input signal that is indicative of a selected lamp lighting level, to provide a control signal to the buck converter circuit as a function of the dim input signal, the control signal indicating a particular duty cycle for the buck converter circuit, the control signal configured such that, during an initial start-up period, the control signal indicates at least a minimum duty cycle for the buck converter circuit, and thereafter the control signal indicates a duty cycle for the buck converter circuit that corresponds to a lamp voltage output signal having a magnitude for energizing the lamp at a selected lamp lighting level from the plurality of lamp lighting levels; wherein in response to the buck converter receiving the control signal, the buck converter circuit adjusts the duty cycle according to the control signal to produce the lamp voltage output signal having the magnitude to energize the lamp at the selected lamp lighting level.

In a related embodiment, the controller may be configured to provide the control signal configured such that if the selected lamp lighting level is below a minimum level, the control signal may indicate the minimum duty cycle for the buck converter circuit during an initial start-up period and thereafter the control signal may indicate a duty cycle for the buck converter circuit that corresponds to a lamp voltage output signal having a magnitude to energize the lamp at the selected lamp lighting level. In a further related embodiment, the controller may be configured to provide the control signal configured such that if the selected lamp lighting level is above a minimum level, the control signal may indicate a duty cycle for the buck converter circuit that corresponds to a lamp voltage output signal having a magnitude to energize the lamp at the selected lamp lighting level.

In another related embodiment, the controller may be configured to provide the control signal configured such that if the selected lamp lighting level is above a minimum level, the control signal may indicate a duty cycle for the buck converter circuit that corresponds to a lamp voltage output signal having a magnitude to energize the lamp at the selected lamp lighting level. In still another related embodiment, the initial start-up period may be at least one a run-up period of time, a preset period of time, and a fixed period of time of at least 90 seconds.

In yet another related embodiment, the ballast may further comprise a dim interface connected to the controller, the dim interface configured to receive user input indicative of the selected lamp lighting level, wherein the dim interface may be at least one of: a step dim interface configured to receive user input indicative of the selected lamp lighting level, wherein the selected lamp lighting level may be selected from a finite number of lamp lighting levels; and a continuous dim interface configured to receive user input indicative of the selected lamp lighting level, wherein the selected lamp lighting level may be selected from a continuous spectrum of lamp lighting levels.

In still yet another related embodiment, the minimum duty cycle may be fixed during the start-up period for all lamp lighting levels in the plurality of lamp lighting levels.

In yet still another related embodiment, the ballast may further include a power regulation circuit to regulate power generated by the buck converter circuit. In a further related embodiment, the power regulation circuit may include: a current feedback circuit to sense current generated by the buck converter circuit; and a voltage feedback circuit to sense voltage generated by the buck converter circuit; wherein the current feedback circuit and the voltage feedback circuit may be connected to the controller such that the power generated by the buck converter circuit is at a minimum level or above. In a further related embodiment, the controller may be configured to receive a current feedback signal from the current feedback circuit, the current feedback signal indicative of the current generated by the buck converter circuit, and the controller may be configured to receive a voltage feedback signal from the voltage feedback circuit, the controller may be configured to determine the power generated by the buck converter circuit as a function of the current feedback signal and the voltage feedback signal, and the controller may be configured to adjust the duty cycle of the buck converter circuit as a function of the power determined to be generated by the buck converter circuit such that the power is at a minimum level or above.

In another embodiment, there is provided a ballast. The ballast includes: a power circuit to energize a lamp; an interface to receive a dim input that is indicative of a selected lamp lighting level less than full power, wherein the selected lamp lighting level is one of a plurality of lamp lighting levels at which the lamp operates; and a controller to control the power circuit to energize the lamp as a function of the dim input, wherein during an initial start-up period, the controller controls the power circuit to energize the ballast at least a minimum duty cycle for the ballast and thereafter the controller controls the power circuit to energize the ballast at a duty cycle that corresponds to the lamp having an output corresponding to the selected lamp lighting level.

In a related embodiment, the power circuit may include: a rectifier to receive an alternating current (AC) voltage signal from an AC power supply and to produce a direct current (DC) voltage signal therefrom; a power factor correction circuit connected to the rectifier to boost the DC voltage signal produced by the rectifier; a buck converter circuit connected to the power factor correction circuit to receive the boosted DC voltage signal from the power factor correction circuit, wherein the boosted DC voltage signal may have a magnitude that is substantially constant, the buck converter circuit may have a duty cycle to generate a DC lamp voltage output signal from the boosted DC voltage signal, wherein the DC lamp voltage output signal may have a magnitude that is varied by the duty cycle in order to energize the lamp at the plurality of lamp lighting levels; and wherein the controller may be connected to the buck converter circuit, the controller may be configured to receive a dim input signal that is indicative of a selected lamp lighting level, the controller may be configured to provide a control signal to the buck converter circuit as a function of the dim input signal, the control signal may indicate a particular duty cycle for the buck converter circuit, the control signal may be configured such that during an initial start-up period, the control signal may indicate at least a minimum duty cycle for the buck converter circuit and thereafter the control signal may indicate a duty cycle for the buck converter circuit that corresponds to a lamp voltage output signal having a magnitude to energize the lamp at the selected lamp lighting level; and wherein the ballast further includes: an inverter connected to the buck converter circuit to convert the DC lamp voltage output signal to an AC lamp voltage output signal to energize the lamp at the selected lamp lighting level; and wherein in response to the buck converter circuit receiving the control signal, the buck converter circuit may adjust the duty cycle according to the control signal to produce the lamp voltage output signal having the magnitude to energize the lamp at the selected lamp lighting level.

In a further related embodiment, the controller may be configured to provide the control signal configured such that if the selected lamp lighting level is below a minimum level, the control signal may indicate a minimum duty cycle for the buck converter circuit during an initial start-up period and thereafter the control signal may indicate a duty cycle for the buck converter circuit that corresponds to a lamp voltage output signal having a magnitude to energize the lamp at the selected lamp lighting level. In a further related embodiment, the controller may be configured to provide the control signal configured such that if the selected lamp lighting level is above a minimum level, the control signal may indicate a duty cycle for the buck converter circuit that corresponds to a lamp voltage output signal having a magnitude to energize the lamp at the selected lamp lighting level.

In another further related embodiment, the controller may be configured to provide the control signal configured such that if the selected lamp lighting level is above a minimum level, the control signal may indicate a duty cycle for the buck converter circuit that corresponds to a lamp voltage output signal having a magnitude to energize the lamp at the selected lamp lighting level. In yet another further related embodiment, the initial start-up period may be at least one of a run-up period of time, a preset period of time, and a fixed period of time of at least 90 seconds.

In another related embodiment, the interface may be connected to the controller, the interface may be configured to receive user input indicative of the selected lamp lighting level, and the interface may be at least one of: a step dim interface, the step dim interface configured to receive user input indicative of the selected lamp lighting level, wherein the selected lamp lighting level may be selected from a finite number of lamp lighting levels; and a continuous dim interface, the continuous dim interface configured to receive user input indicative of the selected lamp lighting level, wherein the selected lamp lighting level may be selected from a continuous spectrum of lamp lighting levels.

In another related embodiment, the minimum duty cycle may be fixed during the start-up period for all lamp lighting levels in the plurality of lamp lighting levels.

In still another related embodiment, the ballast may further include: a power regulation circuit to regulate power generated by the buck converter circuit, the power regulation circuit including a current feedback circuit to sense current generated by the buck converter circuit, and a voltage feedback circuit to sense voltage generated by the buck converter circuit, the current feedback circuit and the voltage feedback circuit may be connected to the controller such that the power is at a minimum level or above; and the controller may be configured to receive a current feedback signal from the current feedback circuit, the current feedback signal indicative of the current generated by the buck converter circuit, and the controller may be configured to receive a voltage feedback signal from the voltage feedback circuit, the controller may be configured to determine the power generated by the buck converter circuit as a function of the current feedback signal and the voltage feedback signal, and the controller may be configured to adjust the duty cycle of the buck converter circuit as a function of the power determined to be generated by the buck converter circuit such that the power is at a minimum level or above.

In another embodiment, there is provided a method of operating a ballast to energize a lamp at a lighting level selected from a plurality of lamp lighting levels. The method includes: receiving a dim input that is indicative of a selected lamp lighting level less than full power for the lamp; during an initial start-up period, energizing the ballast as a function of the dim input for at least a minimum duty cycle for the ballast; and thereafter, energizing the ballast at a duty cycle that corresponds to the lamp having an output corresponding to the selected lamp lighting level.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
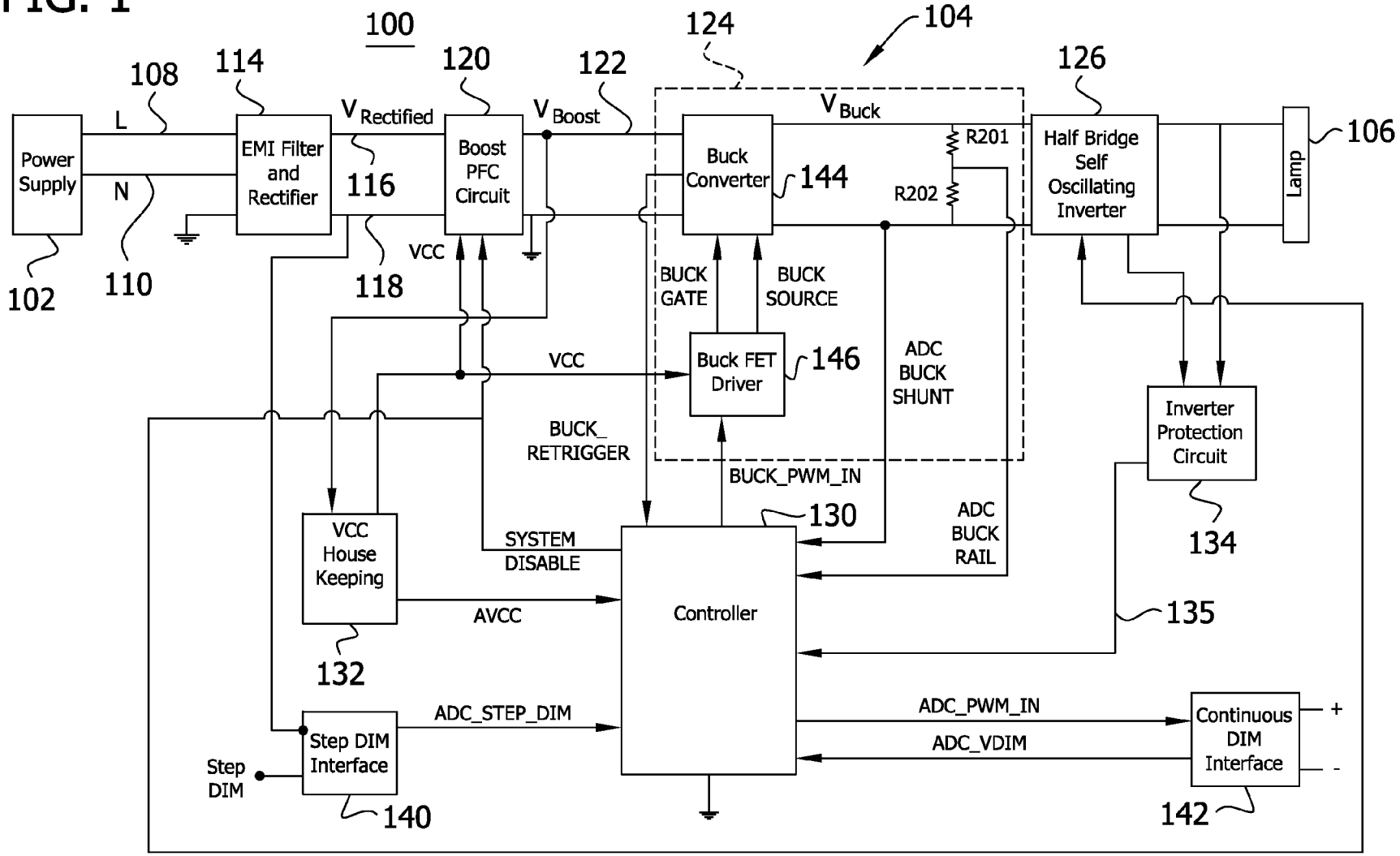
FIG. 1 is a schematic diagram, in block form, of a lamp system according to embodiments disclosed herein.

FIG. 1 illustrates a lamp system 100, which includes an input power source, such as but not limited to an alternating current (AC) power supply 102, an electronic ballast 104 (hereinafter ballast 104), and a lamp 106. It should be noted that the lamp 106, in some embodiments, may be a single lamp, or, in some embodiments, may be a plurality of lamps connected together in series. In some embodiments, the lamp 106 is an electrodeless lamp, such as but not limited to an ICETRON® lamp available from OSRAM SYLVANIA Inc., a QL induction lamp available from Philips, a GENURA lamp available from General Electric, and/or an EVER-LIGHT lamp available from Matsushita. However, the scope of the application contemplates the use of other types of lamps as well.

The ballast 104 includes at least one high voltage input terminal (i.e., line voltage input terminal) 108 adapted for connecting to the alternating current (AC) power supply 102 (e.g., standard 120V AC household power), a neutral input terminal 110, and a ground terminal connectable to ground potential (not illustrated). An input AC power signal is received by the ballast 104 from the AC power supply 102 via the high voltage input terminal 108. The ballast 104 includes an electromagnetic interference (EMI) filter and a rectifier (e.g., full-wave rectifier) 114, which are illustrated together in FIG. 1. The EMI filter portion of the EMI filter and rectifier 114 prevents noise that may be generated by the ballast 104 from being transmitted back to the AC power supply 102. The rectifier portion of the EMI filter and rectifier 114 converts AC voltage received from the AC power supply 102 to direct current (DC) voltage. The rectifier portion includes a first output terminal connected to a DC bus 116 and a second output terminal connected to a ground potential at ground connection point 118. Thus, the EMI filter and rectifier 114 outputs a DC voltage ($V_{Rectified}$) on the DC bus 116.

A power factor correction circuit 120, which may, in some embodiments, be a boost converter, is connected to the first and second output terminals of the EMI filter and rectifier 114. The power factor correction circuit 120 receives the rectified DC voltage ($V_{Rectified}$) and produces a high DC voltage ($V_{Boost}$) on a high DC voltage bus ("high DC bus") 122. For example, the power factor correction circuit 120 may provide a voltage of around 465 volts to the high DC voltage bus 122. A DC to DC converter, such as but not limited to a buck converter circuit 124, is connected to the power factor correction circuit 120 via the high DC voltage bus 122. The buck converter circuit 124 reduces the high DC voltage ($V_{Boost}$) received via the high DC voltage bus 122 and, thus, generates a stepped down DC voltage signal ($V_{Buck}$). An inverter circuit, such as but not limited to a half bridge self oscillating inverter 126 (hereinafter "inverter 126"), is connected to the boost converter circuit 124 for receiving the stepped down DC voltage ($V_{Buck}$) and converting it to AC voltage for supplying to the lamp 106.

As detailed below, the high DC voltage received by the buck converter circuit 124 has a fixed magnitude, and, in some embodiments, a substantially fixed magnitude. The buck converter circuit 124 converts the high DC voltage to a stepped down DC voltage ($V_{Buck}$) that will allow the lamp 106 to operate at a lighting level selected from a plurality of lighting levels. Since the stepped down DC voltage ($V_{Buck}$) produced by the buck converter circuit 124 corresponds to the lighting level generated by the lamp 106, the stepped down DC voltage ($V_{Buck}$) has a magnitude that is variable so that it can be used to operate the lamp 106 at any one of the plurality of lighting levels. For example, the buck converter circuit 124 may reduce the high DC voltage from 465 volts to a voltage in the range of about 140 volts to about 440 volts in order to operate the lamp 106 at one of a plurality of lamp lighting levels. More particularly, the buck converter circuit 124 may reduce the high DC voltage from 465 volts to about 140 volts to operate the lamp 106 at a first lamp lighting level (e.g., 50% of light output), or alternatively, to about 330 volts to operate the lamp 106 at a second lamp lighting level (e.g., 70% of light output), or to about 440 volts to operate the lamp 106 at yet a third lamp lighting level (e.g., 100% of light output).

The lamp system 100 also includes a controller 130 for controlling components of the lamp system 100, and a power supply (VCC) house keeping circuit 132 for powering components of the lamp system 100 including the controller 130. In FIG. 1, the lamp system 100 includes an inverter protection circuit 134 connected to the inverter 126. The inverter protection circuit 134 senses the AC voltage signal being provided to the lamp 106 and detects conditions that warrant shutting down the inverter 126. For example, the inverter protection circuit 134 may detect a degas condition wherein the lamp 106 is connected to the ballast 104 but is broken, cracked, or otherwise not ignited. The inverter protection circuit 134 also may detect a re-lamp condition wherein the lamp 106 is not present or because wires used to connect the lamp 106 to the ballast 104 have become disconnected during normal operation. If the inverter protection circuit 134 detects a condition that warrants shutting down the inverter 126, the inverter protection circuit 134 indicates the presence of the condition to the controller 130 via an input signal 135. In response to receiving input signal 135, the controller 130 shuts down the power factor correction circuit 120 and the inverter 126 via an output signal SYSTEM DISABLE and also turns the buck converter circuit 124 OFF via a gate drive signal BUCK_PWM_IN, as described in greater detail herein.

The controller 130 also communicates with a dim interface and with the buck converter circuit 124 in order control the buck converter circuit 124 so that it generates a stepped down DC voltage ($V_{Buck}$) that corresponds to a lamp lighting level selected by a user via the dim interface. The lamp system 100 shown in FIG. 1 includes two dim interfaces that can be alternatively used to select a lamp lighting level. However, it should be noted that one or more dim interfaces may be used to select the lamp lighting level without departing from the scope of the invention. The lamp system 100 includes a step dim interface 140 that allows a user to select a lamp lighting level from a finite number of lamp lighting levels. The lamp system 100 also includes a continuous dim interface 142 that allows a user to select a lamp lighting level from a continuous spectrum of lamp lighting levels.

In some embodiments, the step dim interface 140 comprises one or more switches connected to the input terminal(s) (high voltage input terminal 108 and/or neutral input terminal 110) of the ballast 104 between the input terminal(s) and the controller 130. Each switch configuration corresponds to a lamp lighting level. Thus, a user selects a particular lamp lighting level by manipulating the one or more switches (e.g., conventional wall switches) to a particular switch configuration. The step dim interface 140 receives a signal STEP DIM indicative of the particular switch configuration and generates a DC voltage signal ADC STEP based on the particular switch configuration. The DC voltage signal ADC STEP is provided to the controller 130 to indicate the selected lamp lighting level. For example, the step dim interface 140 may comprise a switch connected to the high voltage input terminal 108 between the AC power supply 102 and the controller 130. A user selects a first lamp lighting level (e.g., 100% of lamp output) by manipulating the switch to operate in the first configuration, and selects a second lamp lighting level (e.g., 50% of lamp output) by manipulating the switch to operate in a second configuration. When the switch is in the first configuration (e.g., closed, ON), the step dim interface 140 generates the DC voltage signal ADC STEP to have a first voltage level. On the other hand, when the switch is in the second configuration (e.g., open, OFF), the step dim interface 140 generates the DC voltage signal ADC STEP to have a second voltage level. In response to receiving the DC voltage signal ADC STEP having the first voltage level, the controller 130 operates the buck converter circuit 124 so that it produces a stepped down DC voltage ($V_{Buck}$) having a first magnitude for powering the lamp 106 at the first lamp level (e.g., 100% of lamp output). Similarly, in response to receiving the DC voltage signal ADC STEP having the second voltage level, the controller 130 operates the buck converter circuit 124 so that it produces a stepped down DC voltage ($V_{Buck}$) having a second magnitude for powering the lamp 106 at the second lamp level (e.g., 50% of light output).

In some embodiments, the continuous dim interface 142 allows a user to select a voltage from a continuous voltage range of 0 volts to 10 volts. The voltages in the range of 0 volts to 10 volts correspond to lamp lighting levels for producing a range of light output from the lamp 106. For example, the voltages in the range of 0 volts to 10 volts may correspond to lamp lighting levels for producing light output in the range of 40% to 100% of light output for the lamp 106. Thus, a user selects a lamp lighting level by selecting a voltage from the continuous range of voltages. When a user selects the voltage from the continuous range of voltages, the continuous dim interface 142 generates a DC voltage signal ADC_VDIM indicative of the selected voltage. In response to receiving the DC voltage signal ADC_VDIM, the controller 130 operates the buck converter circuit 124 so that it produces a stepped down DC voltage ($V_{Buck}$) having a magnitude for powering the lamp 106 at the selected lamp level. As illustrated in FIG. 1, the controller 130 also provides the continuous dim interface 142 with a pulse width modulated signal (e.g., ADC_PWM_IN) to enable operation thereof as generally known in the art.

In the lamp system 100, the buck converter circuit 124 operates as a switched-mode power supply which has a duty cycle that may be adjusted (e.g., modified) in order to vary power (i.e., current and voltage) produced from the buck converter circuit 124. In particular, the duty cycle of the buck converter circuit 124 may be adjusted to vary the magnitude of the DC voltage signal ($V_{Buck}$) that is produced by the buck converter circuit 124 from the high DC voltage fixed magnitude signal ($V_{Boost}$) received by the buck converter circuit 124. In operation, the lamp system 100 receives user input via the dim interface (step dim interface 140 or continuous dim interface 142) selecting a lamp lighting level. In response to receiving the user input, the dim interface (step dim interface 140 or continuous dim interface 142) generates a dim input signal (e.g., DC voltage signal ADC STEP or ADC_VDIM) and provides the dim input signal to the controller 130. The controller 130 determines a duty cycle (e.g., on switching time and off switching time) for the buck converter circuit 124 that will step down the high DC voltage fixed magnitude signal ($V_{Boost}$) to generate a DC voltage signal ($V_{Buck}$) having a magnitude for energizing the lamp 106 at the selected lamp lighting level. The controller 130 provides a control signal BUCK_PWM_IN to the buck converter circuit 124 indicating the determined duty cycle. In response to receiving the control signal BUCK_PWM_IN from the controller 130, the buck converter circuit 124 adjusts the duty cycle to the determined duty cycle in order to produce the DC voltage signal ($V_{Buck}$) having a magnitude for energizing the lamp 106 at the selected lamp lighting level.

As illustrated in FIG. 1, the buck converter circuit 124 includes a buck converter 144 which is ground referenced. Since the buck converter 144 is ground referenced, the buck converter circuit 124 also includes a buck FET driver 146, such as part FAN7382 High- and Low-Side Gate Driver available from Fairchild Semiconductor. Thus, the buck FET driver 146 receives the control signal BUCK_PWM_IN from the controller 130 and generates switch control signals, BUCK GATE and BUCK SOURCE, for controlling the duty cycle of the buck converter 144 in accordance with the duty cycle indicated in the control signal BUCK_PWM_IN received by the buck FET driver 146. It should be noted that other buck converter circuits or step down DC to DC converters may be used without departing from the scope of the invention.

Figure 2:
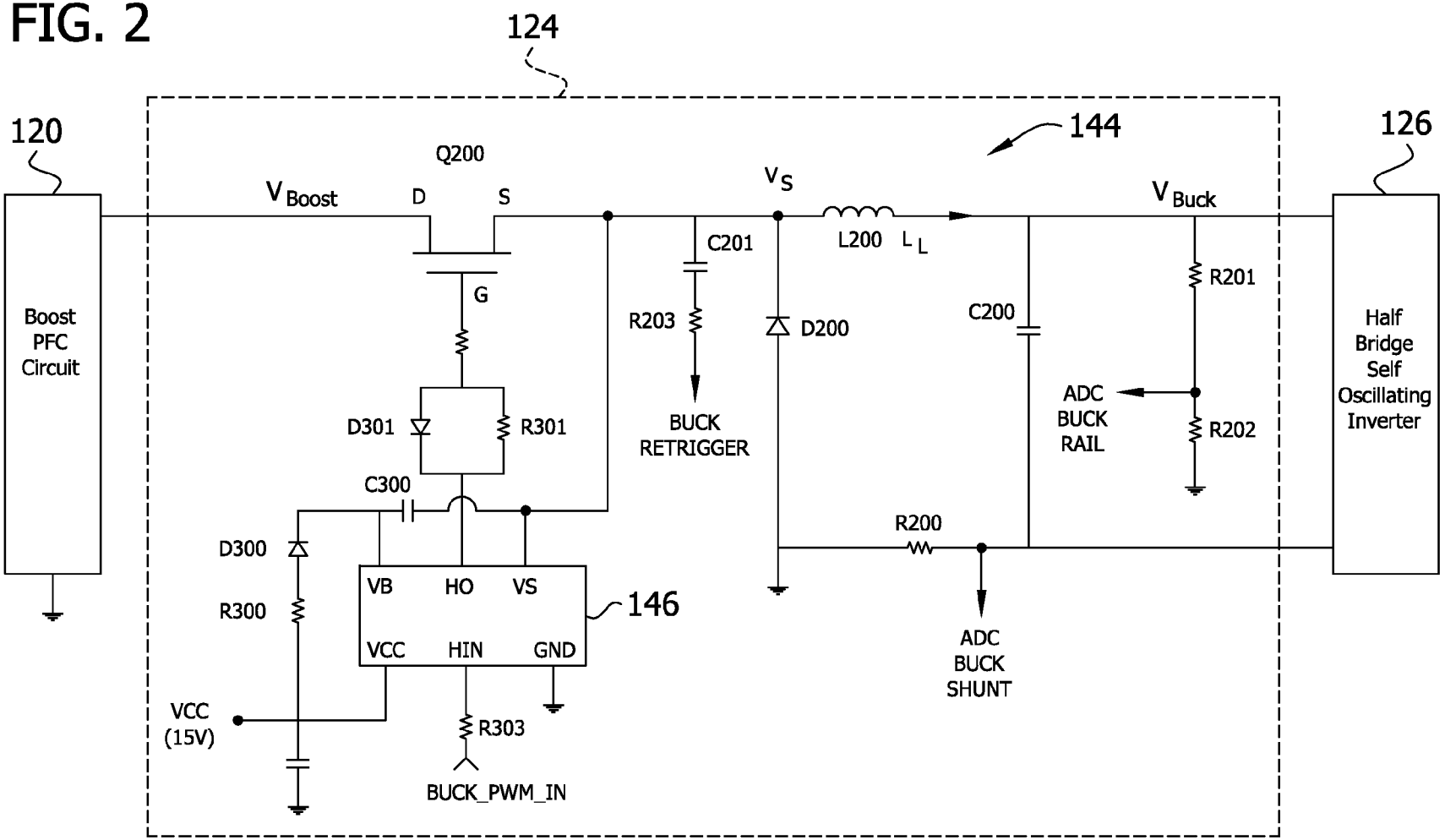
FIG. 2 is a schematic diagram of a buck converter circuit of the lamp system of FIG. 1 according to embodiments disclosed herein.

FIG. 2 is a schematic of an exemplary buck converter circuit 124. As generally known, the buck converter circuit 124 includes a first switch, a second switch, an inductor, and a capacitor. In accordance therewith, the buck converter circuit 124 includes a metal-oxide-semiconductor field-effect transistor (buck MOSFET) Q200, a buck diode D200, a buck inductor L200, and a buck capacitor C200. The buck MOSFET Q200 has a drain terminal, a gate terminal, and a source terminal. It should be noted that other or additional components could be used without departing from the scope of the invention. For example, rather than using the diode D200, the second switch could be another MOSFET connected with the buck MOSFET Q200 so as to generate complementary gate drive outputs. The MOSFET Q200 and the buck diode D200 operate so as to alternately connect and disconnect the buck inductor L200 to the boost PFC circuit 120. In other words, the buck inductor L200 alternately receives the high DC voltage ($V_{Boost}$) from the boost PFC circuit 120 as a function of the buck MOSFET Q200 and the buck diode D200. When the buck MOSFET Q200 is conductive (e.g., closed; ON), current flows from the boost PFC circuit 120 through the buck inductor L200, the buck capacitor C200, and a shunt resistor R200. The high DC voltage ($V_{Boost}$) from the boost PFC circuit 120 reverse-biases the buck diode D200, so no current flows through the buck diode D200. On the other hand, when the buck MOSFET Q200 is non-conductive (e.g., open; OFF), the buck diode D200 is forward biased and thus conducts current. Accordingly, current flows in a path from the buck inductor 200 and passing through the buck capacitor C200, the shunt resistor R200, and the buck diode D200. Thus, the buck inductor 200 stores energy (e.g., charges) from the boost PFC circuit 120 while the buck MOSFET Q200 is conductive and dissipates energy (e.g., discharges) to the inverter 126 while the MOSFET Q200 is non-conductive. The amount of time that the buck MOSFET Q200 is conductive during a period of one conductive and one non-conductive state (i.e., during a period) is the duty cycle for the buck converter circuit 124.

In some embodiments, the buck converter circuit 124 is configured to operate in critical conduction mode. As illustrated in FIG. 2, the buck converter circuit 124 includes circuit components in addition to those discussed above to support operation of the buck converter circuit 124 in this mode. In particular, the buck converter circuit 124 includes a boot strapping circuit (i.e., a capacitor C300, a diode D300, and a resistor R300 shown in FIG. 2) connected between the source terminal of the buck MOSFET Q200 and the power supply for providing a sufficient gate to source voltage for the buck MOSFET Q200. A turn off diode D301 and gate resistors R301 and R302 are connected between the gate terminal of the buck MOSFET Q200 and the buck FET driver 146. A current limiting resistor R303 is connected between the controller 130 and the buck FET driver 146, and a $V_{cc}$ capacitor C301 is connected between the buck FET driver 146 and ground potential. An inductor current sensing circuit comprising a capacitor C201 and a resistor R203 is connected between the source terminal of the buck MOSFET Q200 and the buck inductor L200 and to the controller 130. The inductor sensing circuit provides an input signal BUCK RETRIGGER to the controller 130 indicative of the current through the buck inductor L200. Upon receiving an indication via the input signal BUCK RETRIGGER that the current through the buck inductor L200 has reached zero, the controller 130 sends a signal BUCK_PWM_IN to the buck FET driver 146 to turn the buck MOSFET Q200 on. The BUCK_PWM_IN signal also indicates the length of time ($T_{ON}$) that the buck MOSFET Q200 should be conductive to produce the voltage for generating the selected lamp lighting level.

Referring to FIGS. 1 and 2, in some embodiments, the ballast 104 includes a power regulation circuit for the buck converter 144. As discussed above, the buck converter circuit 124 includes a shunt resistor R200 (broadly, "current feedback circuit") connected at the output of the buck converter 144 between the buck capacitor C200 and ground potential for measuring (e.g., monitoring) current output from the buck converter 144. In particular, the controller 130 is connected to the shunt resistor R200, and receives a current feedback signal ADC BUCK SHUNT which is representative of the current through the shunt resistor R200. The buck converter circuit 124 also includes a resistive network (broadly, "voltage feedback circuit") connected at the output of the buck converter 144 for measuring the voltage produced by the buck converter 144. In FIGS. 1 and 2, the buck converter circuit 124 includes a first resistor R201 and a second resistor R202 connected together in series. The series connected first and second resistors R201 and R202 are connected parallel with the buck capacitor C200 between the buck converter circuit 124 and the inverter 126. The controller 130 is connected between the first resistor R201 and the second resistor R202 for receiving a voltage feedback signal ADC BUCK RAIL, which is representative of the DC voltage $V_{Buck}$ produced by the buck converter 144.

The controller 130 determines the actual power being generated by the buck converter circuit 124 as a function of the current feedback signal ADC BUCK SHUNT and the voltage feedback signal ADC BUCK RAIL. The controller 130 compares the actual power being generated by the buck converter circuit 124 to a target power. The target power is at least a minimum power (i.e., voltage and current) needed to start operation of the lamp 106 so that the lamp 106 can operate at the selected lamp lighting level. The controller 130 controls (e.g., modifies) the duty cycle of the buck converter circuit 124 via the control signal BUCK_PWM_IN as a function of the comparison between the actual power and the target power.

Figure 4:
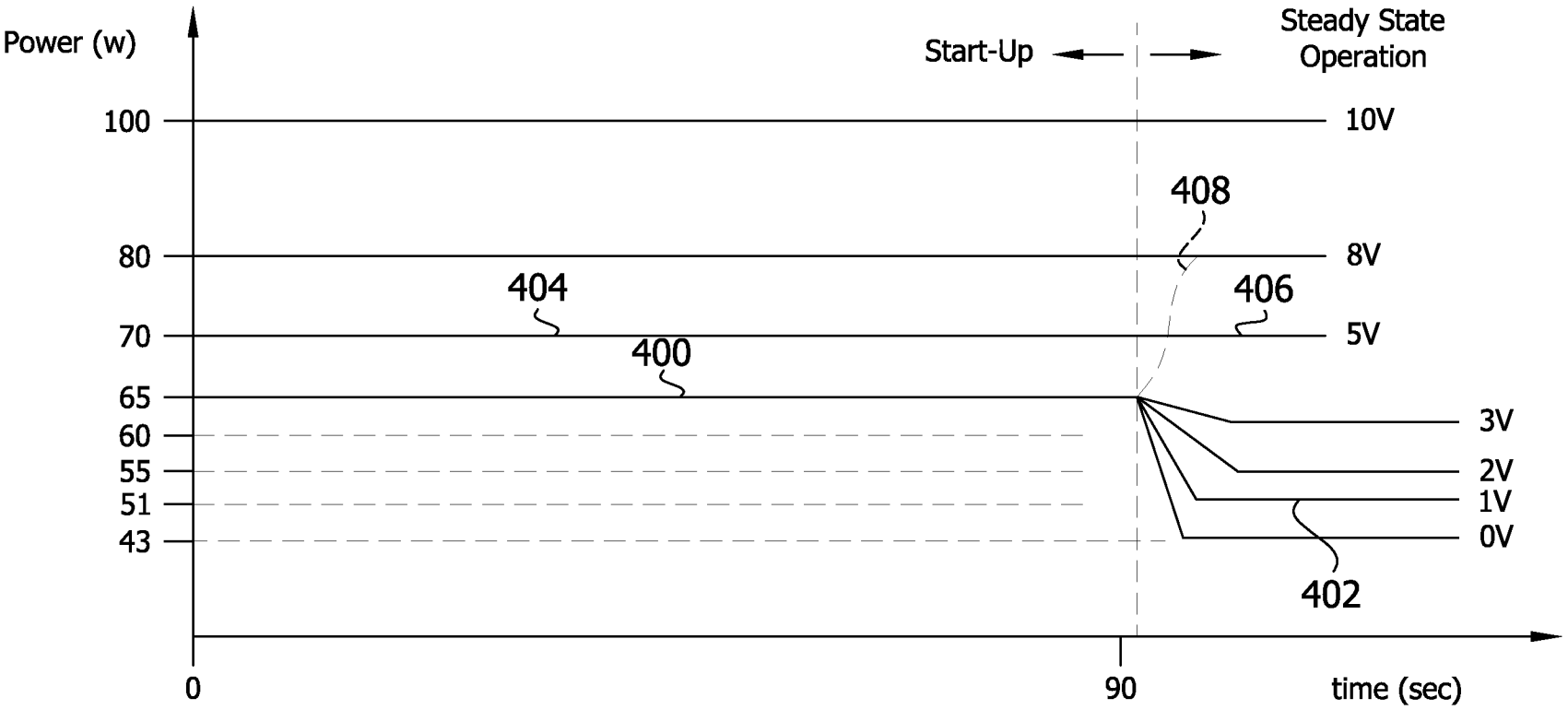
FIG. 4 is graph with power along the vertical y-axis and time along the horizontal x-axis illustrating various start modes according to embodiments disclosed herein.

In some embodiments, the lamp 106 is energized at a minimum power level during start-up (i.e., run-up) to minimize the possibility of the lamp extinguishing during start-up. Once the partial mercury vapor pressure has reached a high enough pressure after start-up, the lamp power can safely be reduced, to dim the lamp to match the selected lamp lighting level without the risk of the lamp extinguishing. Thus, a minimum lamp power limit is set during the start-up period once power is applied to the ballast 104. For example, referring to FIG. 4, assume that the minimum power limit needed to avoid extinguishing a 100 Watt lamp during start-up is 65 Watts. If the selected lamp lighting level of the lamp 106 set by user using a 0-10V interface 140, 142 is less than this minimum power limit, the lamp 106 undergoes normal ignition at a minimum power limit of 65 Watts. During start-up, the lamp 106 is maintained at a power level above the minimum power limit for the start-up period to avoid extinguishing the lamp 106. After the start-up period, the power level is set by the controller 130 to the power level set by the user on the 0-10V interface 140, 142.

For example, if the selected lamp lighting level is 51% light output (i.e., 1V from the interface 140, 142), and the lamp is a 100 Watt lamp, the target power would be 51 Watts, which is below the minimum power limit of 65 Watts needed to avoid the lamp 106 extinguishing during run-up. The controller 130 receives current and voltage feedback signals indicating the power produced by the buck converter circuit 124. Thus, the controller 130 is configured to indicate via the control signal BUCK_PWM_IN that the duty cycle should be at least 65 Watts during the start-up period, as indicated by a line 400. After start-up, the controller 130 is configured to indicate via the control signal BUCK_PWM_IN that the duty cycle should be 51 Watts during the steady state operating period to match the selected lamp lighting level specified by the user, as indicated by a line 402.

On the other hand, if the selected lamp lighting level of the lamp set by user using 0-10V interface 140, 142 is greater than this minimum power limit, the lamp would undergo normal ignition, and instantaneously set itself to the power level set by the user on the 0-10V interface 140, 142. So after normal ignition, even during the start-up period, the power limit on the lamp is the power set by the user on the 0-10V interface 140, 142. For example, if the selected lamp lighting level is 70% light output (i.e., 5V from the interface 140, 142), and the lamp is a 100 Watt lamp, the target power would be 70 Watts, which is above the minimum power level of 65 Watts needed to avoid the lamp 106 extinguishing during run-up. The controller 130 receives current and voltage feedback signals indicating the power produced by the buck converter circuit 124. Thus, the controller 130 is configured to indicate via the control signal BUCK_PWM_IN that the duty cycle should be at 70 Watts during the start-up period, as indicated by a line 404. After start-up, the controller 130 is configured to indicate via the control signal BUCK_PWM_IN that the duty cycle continues to be 70 Watts during the steady state operating period to match the selected lamp lighting level specified by the user, as indicated by a line 406.

Figure 5:
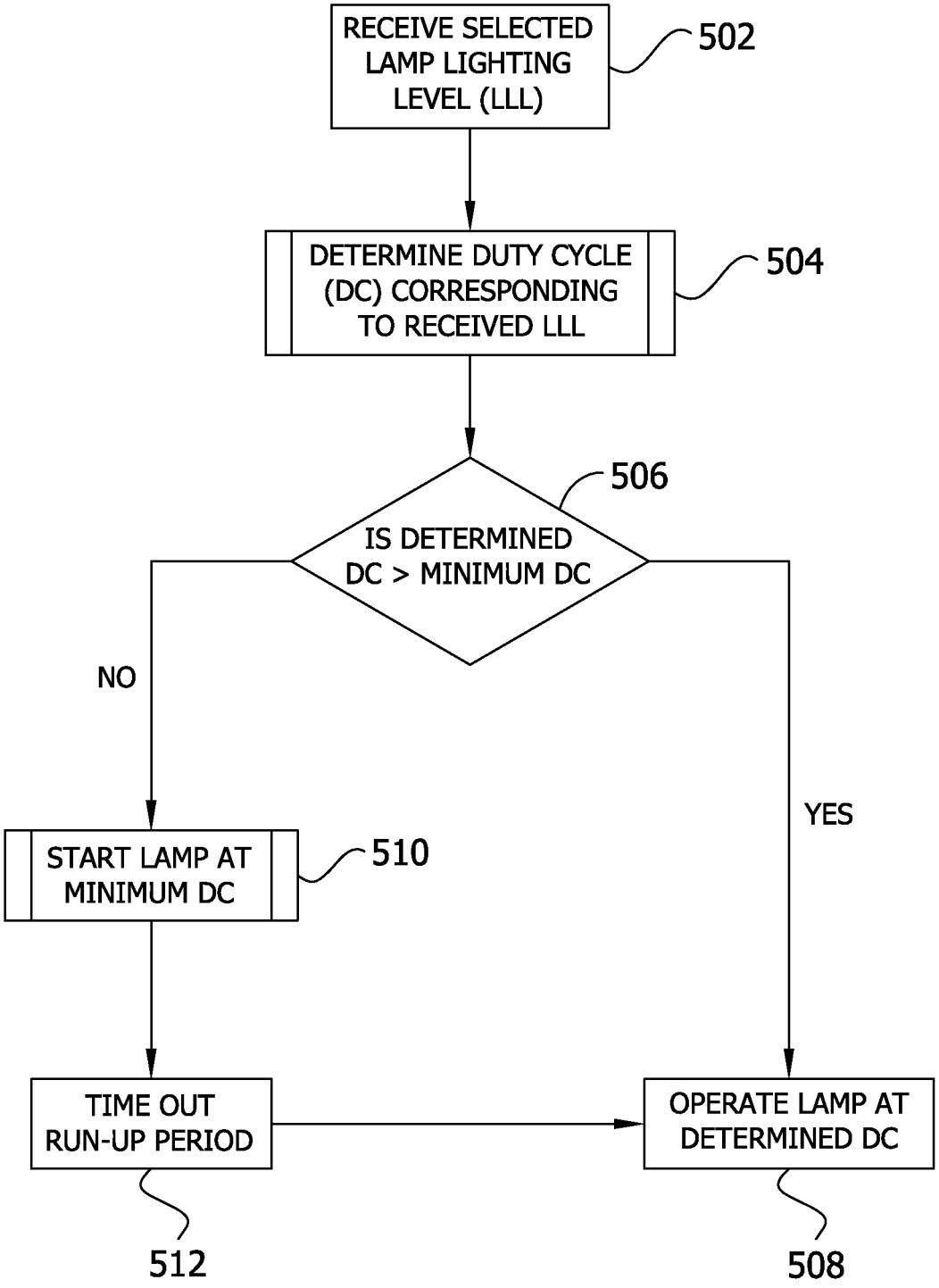
FIG. 5 is a flow chart of instructions for operating a ballast controller according to embodiments disclosed herein.

In other words, if the selected lamp lighting level is below a minimum level, then the controller 130 is configured to provide the target power as the minimum duty cycle for the buck converter circuit 124 during an initial start-up period. After the initial start-up period, the controller determines the target power as a duty cycle for the buck converter circuit 124 that corresponds to a lamp voltage output signal having a magnitude for energizing the lamp at the selected lamp lighting level. FIG. 5 illustrates an embodiment which implements the above.

Figure 6:
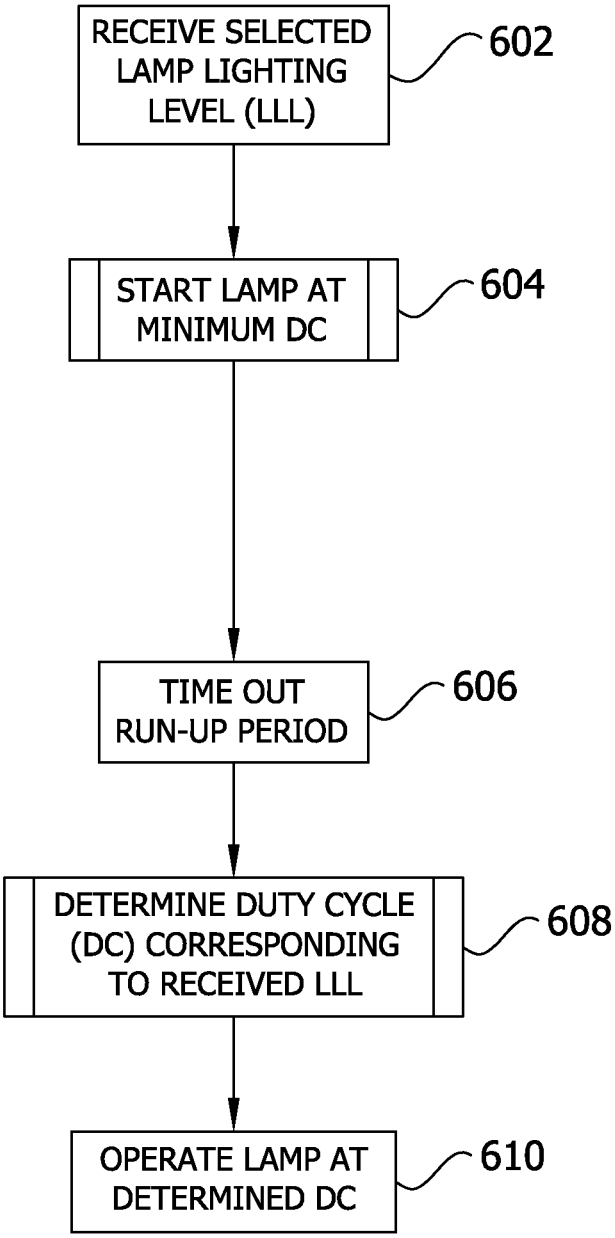
FIG. 6 is a flow chart of instructions for operating a ballast controller according to embodiments disclosed herein.

FIGS. 5 and 6 are flowcharts of instructions performed by the controller 130 shown in FIG. 1. In some embodiments, the controller 130 is a microcontroller that includes a processor (not shown) and a memory system (not shown). The memory system stores a series of instructions that, when executed by the processor, result in the controller 130 operating as described herein. The elements are herein denoted "processing blocks" and represent computer software instructions or groups of instructions. Alternatively, the processing blocks represent steps performed by functionally equivalent circuits such as a digital signal processor circuit or an application specific integrated circuit (ASIC). The flowcharts of FIGS. 5 and 6 do not depict the syntax of any particular programming language, but rather illustrates the functional information one of ordinary skill in the art requires to fabricate circuits or to generate computer software to perform the processing required in accordance with embodiments disclosed herein. It should be noted that many routine program elements, such as but not limited to initialization of loops and variables and the use of temporary variables are not shown. It will be appreciated by those of ordinary skill in the art that unless otherwise indicated herein, the particular sequence of steps described is illustrative only and may be varied without departing from the spirit of the invention. Thus, unless otherwise stated, the steps described below are unordered, meaning that, when possible, the steps may be performed in any convenient or desirable order.

In FIG. 5, the processor of the controller 130 first receives a lamp lighting level (LLL), step 502. In some embodiments, as described herein, the lamp lighting level (LLL) is indicated by a user via the interface 140, 142 shown in FIG. 1. The processor then determines a duty cycle (DC) corresponding to the received lamp lighting level (LLL), step 504. Next, the processor evaluates whether the determined duty cycle (DC) is greater than a minimum duty cycle (DC), step 506. If it is, the controller proceeds to operate as described herein such that the lamp 106 is energized at the determined duty cycle, step 508. If it is not, the controller proceeds to operate as described herein such that the lamp 106 is initially energized at the minimum duty cycle, step 510. After a start-up period times out, step 512, the controller 130 proceeds to operate the lamp 106 at the determined duty cycle, step 508, as described herein, which corresponds to the lamp lighting level (LLL) indicated by the user.

In summary, during an initial start-up period, the controller 130 is configured to provide the target power (i.e., a control signal applied to the controller 130) as at least a minimum duty cycle for the buck converter circuit 124. After the initial start-up period, the controller 130 determines the target power as a duty cycle for the buck converter circuit 124 that corresponds to a lamp voltage output signal having a magnitude for energizing the lamp at the selected lamp lighting level.

It is also contemplated that a fixed minimum duty cycle may be implemented during the start-up period regardless of the user-selected lamp lighting level and that the user-selected lamp lighting level would be implemented after start-up. FIG. 6 illustrates such embodiments. In FIG. 6, the processor of the controller 130 receives a lamp lighting level (LLL), which is indicated by a user via the interface 140, 142, step 602. The processor than causes the controller 130 to operate the lamp 106 at the minimum duty cycle, step 604. After a start-up period times out, step 606, the processor of the controller 130 determines the duty cycle corresponding to the received lamp lighting level specified by the user via the interface 140, 142, step 608. The controller 130 then proceeds to operate the lamp 106 at the determined duty cycle, which corresponds to the lamp lighting level indicated by the user.

In some embodiments, operating the lamp 106 at the minimum duty cycle, step 604, may depend on two or more preset levels, depending on the selected lamp lighting level. For example, the minimum may be 65 W for selected lamp lighting levels of 70 W or less and it may be 70 W for selected lamp lighting levels of more than 70 W. As another example, the minimum may be 65 W for selected lamp lighting levels of 70 W or less and it may be 100 W for selected lamp lighting levels of more than 70 W. For example, if the selected lamp lighting level is 80% light output (i.e., 8V from the interface 140, 142), and the lamp is a 100 Watt lamp, the target power would be 80 Watts, which is above the minimum power level of 65 Watts needed to avoid the lamp 106 extinguishing during run-up. The controller 130 receives current and voltage feedback signals indicating that the power produced by the buck converter circuit 124. Thus, the controller 130 is configured according to FIG. 6 to indicate via the control signal BUCK_PWM_IN that the duty cycle should be at 65 Watts during the start-up period, as indicated by the line 400 shown in FIG. 4. After start-up, the controller 130 is configured to indicate via the control signal BUCK_PWM_IN that the duty cycle should be 80 Watts during the steady state operating period to match the selected lamp lighting level specified by the user, as indicated by a dashed line 408 in FIG. 4.

In embodiments described throughout, the initial start-up period is at least one of the following: a run-up period of time (either predetermined or measured); a preset period of time (which may be greater than the run-up period); and a fixed period of time (e.g., at least 90 seconds). A fixed period of time of at least 90 seconds is contemplated in some embodiments because most lamps will reach a steady state after 90 seconds. It is also contemplated that a controller could initially energize the lamp 106 at the minimum duty cycle and monitor a parameter indicative of the operation of the lamp 130. When the monitored parameter indicates that the run-up period has ended and the lamp is stable, then the controller 130 would switch to operate at the duty cycle corresponding to the selected lamp lighting level.

The following Table 1 includes values according to embodiments described in connection with FIG. 5:

TABLE 1

| 0-10 V INPUT | LAMP POWER SET (START-UP) | LAMP POWER AFTER START-UP TIME |
|---|---|---|
| 10 V | 100 W (MAX) | 100 W |
| 8 V | 80 W | 80 W |
| 5 V | 70 W | 70 W |
| 3 V | 65 W* | 60 W |
| 2 V | 65 W* | 55 W |
| 1 V | 65 W* | 51 W |
| 0 V | 65 W* | 43 W |

*Minimum power level run-up

The following Table 2 includes values according to embodiments described in connection with FIG. 6:

TABLE 2

| 0-10 V INPUT | LAMP POWER SET *(START-UP) | LAMP POWER AFTER START-UP TIME |
|---|---|---|
| 10 V | 100 W | 100 W |
| 8 V | 100 W | 80 W |

TABLE 2-continued

| 0-10 V INPUT | LAMP POWER SET *(START-UP) | LAMP POWER AFTER START-UP TIME |
|---|---|---|
| 5 V | 65 W | 70 W |
| 3 V | 65 W | 60 W |
| 2 V | 65 W | 55 W |
| 1 V | 65 W | 51 W |
| 0 V | 65 W | 43 W |

*Fixed power level run-up

Figure 3:
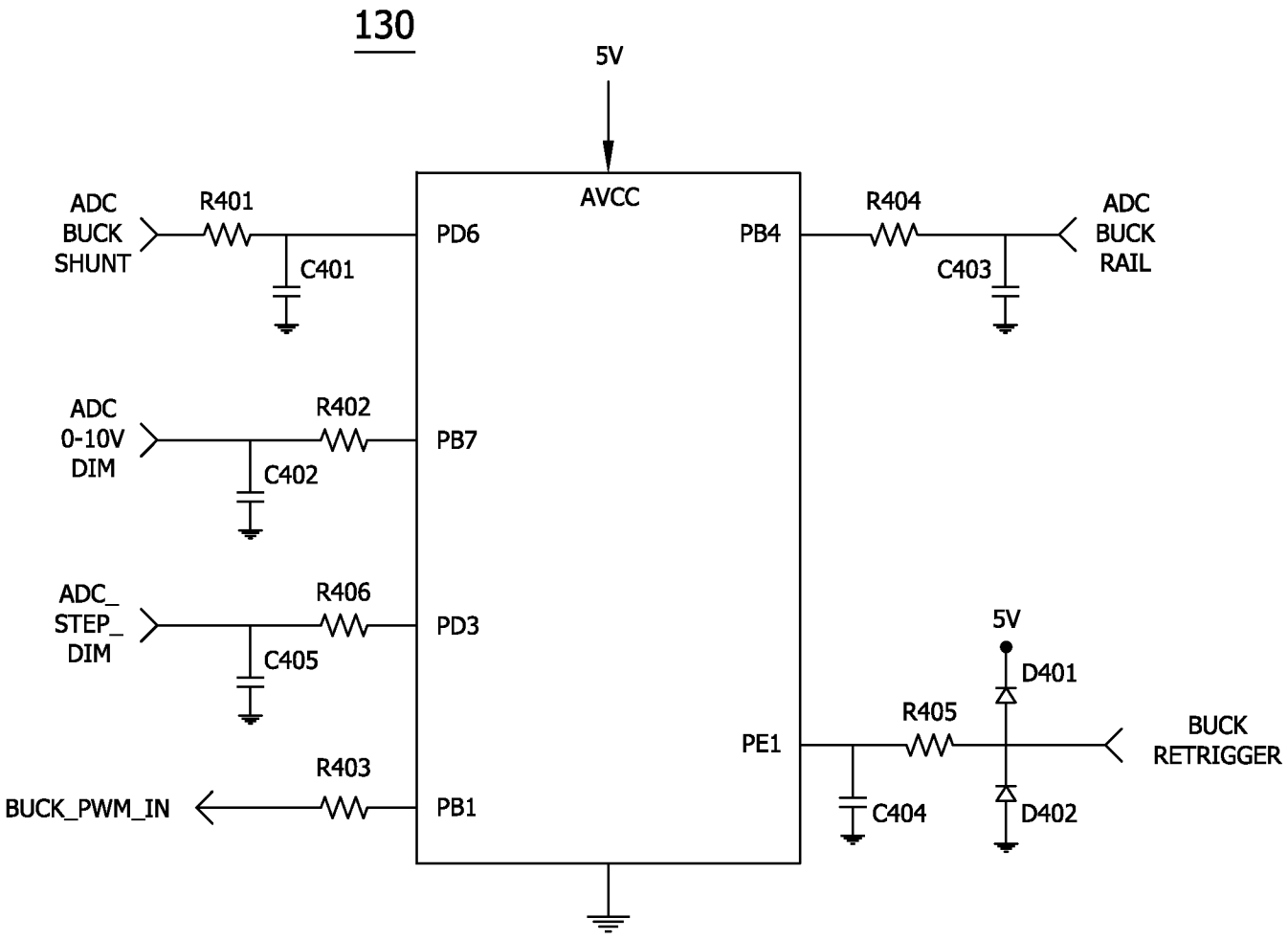
FIG. 3 is an exemplary pin out diagram of a controller according to embodiments disclosed herein.

FIG. 3 illustrates an exemplary pin out diagram for the controller 130 shown in FIG. 1 and connected to elements described in FIGS. 1 and 2. As discussed above, the controller 130 receives a power supply AVCC for powering the controller 130 from the VCC house keeping circuit 132. The controller 130 is configured to receive a step dim input signal ADC_STEP_DIM via a first RC filter circuit, comprising a resistor R406 and a capacitor C405, and a continuous dim input signal ADC_VDIM via a second RC filter circuit, comprising a resistor R402 and a capacitor C402. The dim input signals ADC_STEP_DIM and ADC_VDIM indicate a selected lamp lighting level. The controller 130 controls the duty cycle of the buck converter 144 via a control signal BUCK_PWM_IN and a current sensing signal BUCK_RETRIGGER. In particular, the controller 130 is configured to monitor the current through the buck inverter L200 via current sensing signal BUCK_RETRIGGER. When the current sensing signal BUCK_RETRIGGER indicates that the current across through the buck inverter L200 reaches zero, the controller 130 indicates to the buck FET driver 146 via the control signal BUCK_PWM_IN that the duty cycle should be turned on and specifies the length of time ($T_{on}$) for which it should be on ($T_{on}$). The controller 130 determines the length of time that the duty cycle should be on as a function of the dim input signals ADC_STEP_DIM and ADC_VDIM.

The controller 130 is configured to receive a current feedback signal ADC BUCK SHUNT via a third RC filter circuit, comprising a resistor R401 and a capacitor C401, and a voltage feedback signal ADC BUCK RAIL via a fourth RC filter circuit, comprising a resistor R404 and a capacitor C403. Together, the current feedback signal ADC BUCK SHUNT and the voltage feedback signal ADC BUCK RAIL indicate the power generated by the buck converter 144. The controller 130 compares the power generated by the converter 144 to a target power which it determines from the dim input signals ADC_STEP_DIM and ADC_VDIM. The controller 130 is configured to control the duty cycle of the buck converter 144 via the control signal BUCK_PWM_IN in accordance with the comparison so that the buck converter 144 produces the target power for generating the selected lamp lighting level.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer (s), workstation(s) (e.g., Sun, HP), personal digital assistant (s) (PDA(s)), handheld device(s) such as cellular telephone(s) or smart cellphone(s), laptop(s), handheld computer(s), or another device(s) capable of being integrated with a processor (s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast, comprising:

a rectifier to receive an alternating current (AC) voltage signal from an AC power supply and to produce a direct current (DC) voltage signal therefrom;

a buck converter circuit connected to the rectifier to receive the DC voltage signal, wherein the DC voltage signal has a magnitude that is substantially constant, the buck converter circuit has a duty cycle to generate a lamp voltage output signal from the DC voltage signal, the lamp voltage output signal applied to a lamp to energize the lamp, wherein the lamp voltage output signal has a magnitude that is varied by the duty cycle to energize the lamp at a plurality of lamp lighting levels; and a controller connected to the buck converter circuit, the controller configured to receive a dim input signal that is indicative of a selected lamp lighting level, to provide a control signal to the buck converter circuit as a function of the dim input signal, the control signal indicating a particular duty cycle for the buck converter circuit, the control signal configured such that, during an initial start-up period, the control signal indicates at least a minimum duty cycle for the buck converter circuit, and thereafter the control signal indicates a duty cycle for the buck converter circuit that corresponds to a lamp voltage output signal having a magnitude for energizing the lamp at a selected lamp lighting level from the plurality of lamp lighting levels;

wherein in response to the buck converter receiving the control signal, the buck converter circuit adjusts the duty cycle according to the control signal to produce the lamp voltage output signal having the magnitude to energize the lamp at the selected lamp lighting level.

2. The ballast of claim 1, wherein the controller is configured to provide the control signal configured such that if the selected lamp lighting level is below a minimum level, the control signal indicates the minimum duty cycle for the buck converter circuit during an initial start-up period and thereafter the control signal indicates a duty cycle for the buck converter circuit that corresponds to a lamp voltage output signal having a magnitude to energize the lamp at the selected lamp lighting level.

3. The ballast of claim 2, wherein the controller is configured to provide the control signal configured such that if the selected lamp lighting level is above a minimum level, the control signal indicates a duty cycle for the buck converter circuit that corresponds to a lamp voltage output signal having a magnitude to energize the lamp at the selected lamp lighting level.

4. The ballast of claim 1, wherein the controller is configured to provide the control signal configured such that if the selected lamp lighting level is above a minimum level, the control signal indicates a duty cycle for the buck converter circuit that corresponds to a lamp voltage output signal having a magnitude to energize the lamp at the selected lamp lighting level.

5. The ballast of claim 1, wherein the initial start-up period is at least one a run-up period of time, a preset period of time, and a fixed period of time of at least 90 seconds.

6. The ballast of claim 1, further comprising a dim interface connected to the controller, the dim interface configured to receive user input indicative of the selected lamp lighting level, wherein the dim interface is at least one of:

a step dim interface configured to receive user input indicative of the selected lamp lighting level, wherein the selected lamp lighting level is selected from a finite number of lamp lighting levels; and a continuous dim interface configured to receive user input indicative of the selected lamp lighting level, wherein the selected lamp lighting level is selected from a continuous spectrum of lamp lighting levels.

7. The ballast of claim 1, wherein the minimum duty cycle is fixed during the start-up period for all lamp lighting levels in the plurality of lamp lighting levels.

8. The ballast of claim 1, further comprising a power regulation circuit to regulate power generated by the buck converter circuit.

9. The ballast of claim 8, wherein the power regulation circuit comprises:

a current feedback circuit to sense current generated by the buck converter circuit; and a voltage feedback circuit to sense voltage generated by the buck converter circuit;

wherein the current feedback circuit and the voltage feedback circuit are connected to the controller such that the power generated by the buck converter circuit is at a minimum level or above.

10. The ballast of claim 9, wherein the controller is configured to receive a current feedback signal from the current feedback circuit, the current feedback signal indicative of the current generated by the buck converter circuit, and wherein the controller is configured to receive a voltage feedback signal from the voltage feedback circuit, wherein the controller is configured to determine the power generated by the buck converter circuit as a function of the current feedback signal and the voltage feedback signal, and the controller is configured to adjust the duty cycle of the buck converter circuit as a function of the power determined to be generated by the buck converter circuit such that the power is at a minimum level or above.

11. A ballast, comprising:

a power circuit to energize a lamp;

an interface to receive a dim input that is indicative of a selected lamp lighting level less than full power, wherein the selected lamp lighting level is one of a plurality of lamp lighting levels at which the lamp operates; and a controller to control the power circuit to energize the lamp as a function of the dim input, wherein during an initial start-up period, the controller controls the power circuit to energize the ballast at least a minimum duty cycle for the ballast and thereafter the controller controls the power circuit to energize the ballast at a duty cycle that corresponds to the lamp having an output corresponding to the selected lamp lighting level; and wherein the power circuit comprises:

a rectifier to receive an alternating current (AC) voltage signal from an AC power supply and to produce a direct current (DC) voltage signal therefrom;

a power factor correction circuit connected to the rectifier to boost the DC voltage signal produced by the rectifier;

a buck converter circuit connected to the power factor correction circuit to receive the boosted DC voltage signal from the power factor correction circuit, wherein the boosted DC voltage signal has a magnitude that is substantially constant, the buck converter circuit has a duty cycle to generate a DC lamp voltage output signal from the boosted DC voltage signal, wherein the DC lamp voltage output signal has a magnitude that is varied by the duty cycle in order to energize the lamp at the plurality of lamp lighting levels; and wherein the controller is connected to the buck converter circuit, the controller configured to receive a dim input signal that is indicative of a selected lamp lighting level, the controller configured to provide a control signal to the buck converter circuit as a function of the dim input signal, the control signal indicating a particular duty cycle for the buck converter circuit, the control signal configured such that during an initial start-up period, the control signal indicates at least a minimum duty cycle for the buck converter circuit and thereafter the control signal indicates a duty cycle for the buck converter circuit that corresponds to a lamp voltage output signal having a magnitude to energize the lamp at the selected lamp lighting level; and wherein the ballast further comprises:

an inverter connected to the buck converter circuit to convert the DC lamp voltage output signal to an AC lamp voltage output signal to energize the lamp at the selected lamp lighting level;

and wherein in response to the buck converter circuit receiving the control signal, the buck converter circuit adjusts the duty cycle according to the control signal to produce the lamp voltage output signal having the magnitude to energize the lamp at the selected lamp lighting level.

12. The ballast of claim 11, wherein the controller is configured to provide the control signal configured such that if the selected lamp lighting level is below a minimum level, the control signal indicates a minimum duty cycle for the buck converter circuit during an initial start-up period and thereafter the control signal indicates a duty cycle for the buck converter circuit that corresponds to a lamp voltage output signal having a magnitude to energize the lamp at the selected lamp lighting level.

13. The ballast of claim 12, wherein the controller is configured to provide the control signal configured such that if the selected lamp lighting level is above a minimum level, the control signal indicates a duty cycle for the buck converter circuit that corresponds to a lamp voltage output signal having a magnitude to energize the lamp at the selected lamp lighting level.

14. The ballast of claim 11, wherein the controller is configured to provide the control signal configured such that if the selected lamp lighting level is above a minimum level, the control signal indicates a duty cycle for the buck converter circuit that corresponds to a lamp voltage output signal having a magnitude to energize the lamp at the selected lamp lighting level.

15. The ballast of claim 11, wherein the initial start-up period is at least one of a run-up period of time, a preset period of time, and a fixed period of time of at least 90 seconds.

16. The ballast of claim 11, wherein the interface is connected to the controller, the interface is configured to receive user input indicative of the selected lamp lighting level, and wherein the interface is at least one of:

a step dim interface, the step dim interface configured to receive user input indicative of the selected lamp lighting level, wherein the selected lamp lighting level is selected from a finite number of lamp lighting levels; and a continuous dim interface, the continuous dim interface configured to receive user input indicative of the selected lamp lighting level, wherein the selected lamp lighting level is selected from a continuous spectrum of lamp lighting levels.

17. The ballast of claim 11, wherein the minimum duty cycle is fixed during the start-up period for all lamp lighting levels in the plurality of lamp lighting levels.

18. The ballast of claim 11, further comprising:

a power regulation circuit to regulate power generated by the buck converter circuit, the power regulation circuit comprising a current feedback circuit to sense current generated by the buck converter circuit, and a voltage feedback circuit to sense voltage generated by the buck converter circuit, the current feedback circuit and the voltage feedback circuit being connected to the controller such that the power is at a minimum level or above;

and wherein the controller is configured to receive a current feedback signal from the current feedback circuit, the current feedback signal indicative of the current generated by the buck converter circuit, and wherein the controller is configured to receive a voltage feedback signal from the voltage feedback circuit, wherein the controller is configured to determine the power generated by the buck converter circuit as a function of the current feedback signal and the voltage feedback signal, and the controller is configured to adjust the duty cycle of the buck converter circuit as a function of the power determined to be generated by the buck converter circuit such that the power is at a minimum level or above.

* * * * *